United States Patent [19]

Tsuzurahara et al.

[11] Patent Number: 4,684,845

[45] Date of Patent: Aug. 4, 1987

[54] MAGNETRON CATHODE ASSEMBLY WITH GROOVED INSULATING SPACER

[75] Inventors: Mamoru Tsuzurahara; Hidetsuyo Baba; Seiji Kitakaze, all of Mobara, Japan

[73] Assignee: Hitachi, Ltd., Tokyo, Japan

[21] Appl. No.: 728,825

[22] Filed: Apr. 30, 1985

[30] Foreign Application Priority Data

May 7, 1984 [JP] Japan ..... 59-89391
Jul. 27, 1984 [JP] Japan ..... 59-155202

[51] Int. Cl.[4] ..... H01J 1/15; H01J 1/88; H01J 19/08; H01J 19/42

[52] U.S. Cl. ..... 313/341; 313/340; 313/257; 313/274

[58] Field of Search ..... 313/341, 340, 257, 274, 313/277

[56] References Cited

U.S. PATENT DOCUMENTS 4,344,807 8/1982 Dennesen et al. ..... 156/173
4,524,296 6/1985 Nakayama et al. ..... 313/340
4,558,250 12/1985 Tsuzurabara ..... 313/341

*Primary Examiner*—David K. Moore
*Assistant Examiner*—Theodore Salindong
*Attorney, Agent, or Firm*—Charles E. Pfund

[57] ABSTRACT

In a magnetron cathode assembly having a filament for emitting thermoelectrons, upper and lower end shields fixed at upper and lower ends of the filament, a center lead fixed at and connected to the upper end shield, a side lead fixed at and connected to the lower end shield, and an insulating spacer having through holes with which the center and side leads are respectively engaged, the insulating spacer comprises a groove which has a width substantially the same as a diameter of one of the through holes and which clamps a bent portion of at least one of the center and side leads.

10 Claims, 17 Drawing Figures

MAGNETRON CATHODE ASSEMBLY WITH GROOVED INSULATING SPACER

BACKGROUND OF THE INVENTION

The present invention relates to a magnetron cathode assembly and, more particularly, to a magnetron cathode assembly wherein a resistance to vibration of a filament thereof is improved.

In a conventional magnetron cathode assembly, the following problem is presented. A center lead and a side lead are simply fitted in a spacer for preventing them from vibration. For example, when the center lead starts vibration, the spacer is pivoted about the side lead. In other words, the antiresonance properties of the spacer have directivity, thus failing to provide sufficient mechanical strength. This drawback will be described in detail with reference to FIGS. 1A and 1B which structure is of the type described in U.S. Pat. No. 4,558,250, isued on Dec. 10, 1985 to M. Tsuzurabara.

FIG. 1A is a longitudinal sectional view of a conventional magnetron cathode assembly, and FIG. 1B is a cross-sectional view thereof taken along the line I–I′ of FIG. 1. Referring to FIG. 1A, a filament 1 is arranged along the axis of the magnetron to emit thermoelectrons and clamped between an upper end shield 2 and a lower end shield 3 which prevent the filament 1 from removal. A center lead 4 and a side lead 5 are connected to the upper and lower end shields 2 and 3, respectively. Terminals 6 and a ceramic stem 7 are welded by silver-copper brazing to the lower ends of the center and side leads 4 and 5, respectively. The center and side leads 4 and 5 are respectively fitted in through holes formed in an insulating spacer 8. The insulating spacer 8 serves to prevent the leads 4 and 5 from being disconnected due to external vibration. A sleeve 9 is welded on one (in the example, the sleeve 9 is welded on the side lead 5) of the center and side leads 4 and 5 to position the spacer 8.

Although the antiresonance properties are provided by the spacer, resonance occurs since the center and side leads have different lengths and different resonance frequencies. The surfaces of the filament 1 is carbonated to improve thermoelectron emission efficiency of the filament 1. Therefore, the filament 1 is brittle. When one of the center and side leads 4 and 5 starts vibration, the filament 1 cannot follow the deformation of the vibrating lead 4 or 5 and is thus disconnected. In order to prevent this, the spacer 8 serves to cancel vibration behaviors of the center and side leads 4 and 5. However, when an actual resonance state is observed, the center lead 4 has a larger amplitude since it has a lower resonance frequency than that of the side lead 5 by a value corresponding to a difference between lengths thereof.

As shown in FIG. 1B, the spacer 8 provides sufficient antiresonance properties along the direction A–A′. However, since the center and side leads 4 and 5 are simply fitted in the spacer 8, the spacer cannot provide sufficient antiresonance properties along the direction B–B′. When one lead starts vibration, the spacer starts pivoting about the other lead along the rotational direction indicated by arrow C–C′.

In order to solve the above problem, a conventional means is provided wherein an expensive material such as molybdenum is used to increase the diameter of the lead. Another conventional means is also provided wherein metallized films are formed in lead through holes and the leads 4 and 5 are fixed by an expensive silver-copper brazing material therein. All these conventional means result in high cost, resulting in inconvenience.

SUMMARY OF THE INVENTION

It is, therefore, an object of the present invention to provide a magnetron cathode assembly having good antiresonance properties at low cost.

According to an aspect of the present invention, there is provided a magnetron cathode assembly wherein center and side leads are respectively fitted in circular through holes formed in an insulating spacer, a bent portion of at least one of the center and side leads is clamped in the insulating spacer, and a groove having substantially the same width as the diameter of the through hole is formed in the insulating spacer.

According to another aspect of the present invention, there is provided a magnetron cathode assembly wherein center and side leads are respectively fitted in an elliptical or rectangular through hole formed in an insulating spacer and a circular through hole therein, and at least part of a bent portion of the center lead is clamped by the insulating spacer.

DESCRIPTION OF THE PREFERRED EMBODIMENTS

Figure 1A:
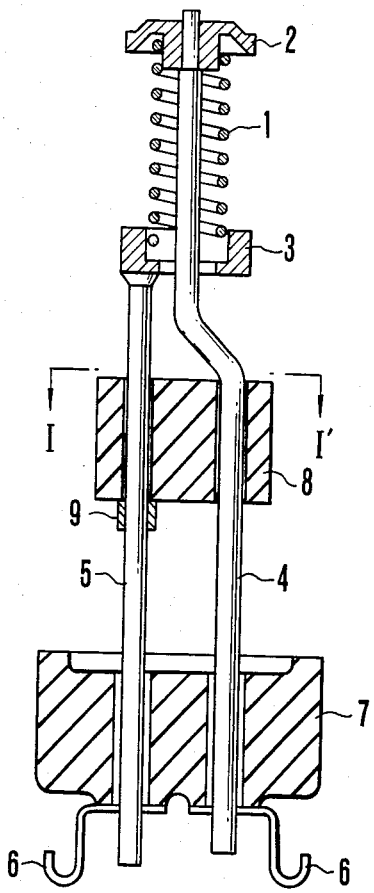
FIG. 1A PRIOR ART
FIGS. 1A and 1B are respectively a longitudinal sectional view showing a main part of a conventional magnetron cathode assembly and a cross-sectional view thereof taken along the line I–I′ of FIG. 1A.

The present invention will be described in detail with reference to preferred embodiments. The same reference numerals as in FIGS. 1A and 1B denote the same parts throughout the specification, and a detailed description thereof will be omitted.

Figure 2A:
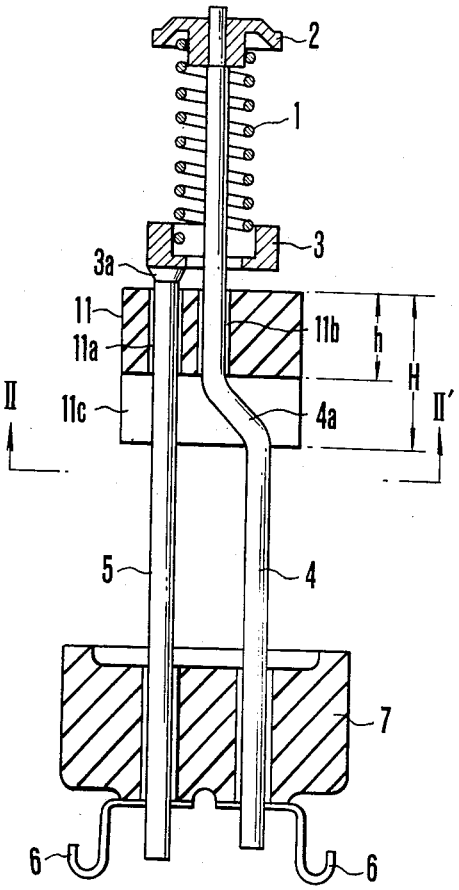
FIGS. 2A and 2B are respectively a longitudinal sectional view showing the main part of a magnetron cathode assembly according to an embodiment of the present invention and a cross-sectional view thereof taken along the line II–II′ of FIG. 2A.
Figure 1B:
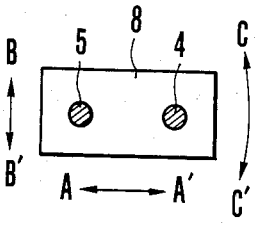
FIG. 1B PRIOR ART
Figure 2B:
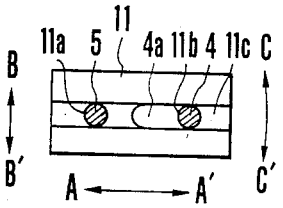

FIG. 2A is a longitudinal sectional view showing the main part of a magnetron cathode assembly according to an embodiment of the present invention and FIG. 2B is a cross-sectional view thereof taken along the line II–II′ of FIG. 1A. A center lead 4 and a side lead 5 are respectively fitted in through holes 11*a* and 11*b* formed in an insulating spacer 11 of a ceramic material. A groove 11*c* is also formed in the insulating spacer 11. A width of the groove 11*c* is substantially the same as a diameter of each through hole 11*a* or 11*b*. A bent portion 4*a* of the center lead 4 is clamped in the groove 11*c*. Unlike the conventional magnetron cathode assembly, when the center lead 4 is apt to move in a direction indicated by arrow C–C′, the center lead 4 is twisted to produce a force which prevents pivotal movement of the spacer 11 along the direction indicated by arrow C–C′. The spacer 11 is prevented by a bent portion 4*a* of the center lead 4 from being moved toward a ceramic stem 7. The movement of the spacer 11 along the direction opposing the above movement can also be prevented by a welded portion 3*a* of the side lead 5 which is welded with a lower end shield 3. Therefore, the sleeve 9 shown in FIG. 1A can be omitted. With the structure of FIGS. 2A and 2B, the antiresonance effect is improved when a portion of the spacer 11 in which the through holes 11*a* and 11*b* are formed has a relatively large height h. However, when the height h is too large, the overall height H of the spacer 11 may become large enough to adversely affect the resonance characteristics of the magnetron in the A—A direction. Thus, the height h is experimentally determined at a predetermined value.

Figure 3A:
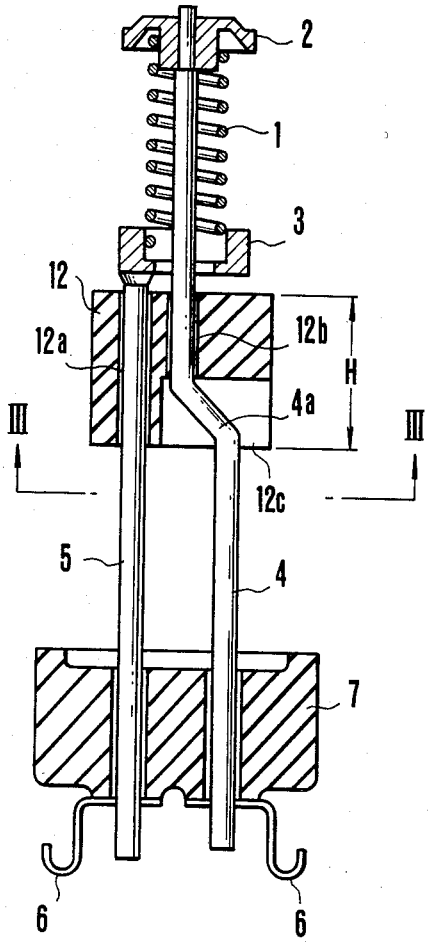
FIGS. 3A and 3B are respectively a longitudinal sectional view showing the main part of a magnetron cathode assembly according to another embodiment of the present invention and a cross-sectional view thereof taken along the line III–III′ of FIG. 3A.
Figure 3B:
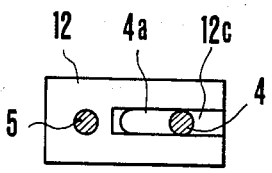

FIGS. 3A and 3B are respectively a longitudinal sectional view showing the main part of a magnetron cathode assembly according to another embodiment of the present invention and a cross-sectional view thereof taken along the line III–III′ of FIG. 3A. Referring to FIGS. 3A and 3B, unlike the assembly of FIGS. 2A and 2B, a portion of an insulating (e.g., ceramic) spacer 12 which corresponds to a side lead 5 has only a through hole 12*a*, and a portion corresponding to a center lead 4 has a through hole 12*b* and a groove 12*c* formed integrally with the through hole 12*b*. A bent portion 4*a* of the center lead 4 is clamped in the groove 12*c*. In this case, the groove 12*c* has a width which is substantially the same as a diameter of the through hole 12*b*. In other words, the groove 12*c* is formed only at the side of the center lead 4.

With the above structure, the same effect as in the assembly shown in FIGS. 2A and 2B is obtained. Furthermore, the overall height H of the spacer 12 can be decreased as compared with that of FIGS. 2A and 2B.

Figure 4:
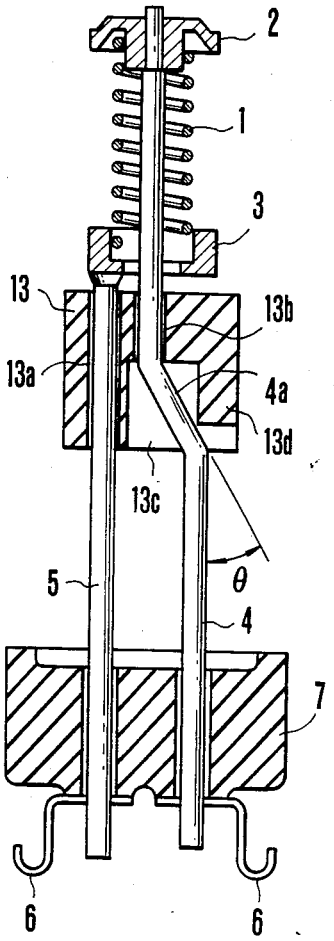
FIGS. 4 to 7 are longitudinal sectional views showing the main parts of magnetron cathode assemblies according to other embodiments of the present invention, respectively.

FIG. 4 shows a magnetron cathode assembly according to still another embodiment of the present invention. Unlike the assembly of FIGS. 3A and 3B, a step 13*d* is formed in a groove 13*c* of a spacer 13 for clamping only a bent portion 4*a* of a center lead 4. Reference numerals 13*a* and 13*b* denote through holes, respectively.

With the above structure, the step 13*d* is in contact with a bent portion 4*a* of the center lead 4 to accurately align the center lead with a side lead 5 and prevent a filament 1 from deformation. If the step 13*d* is not present, an error occurs in the gap between the center and side leads 4 and 5, and the filament 1 is slightly deformed since a gap between the through hole 13*b* and the center lead 4 can be formed and part of the bent portion 4*a* is undesirably entered into the through hole 13*b* in accordance with a bending angle $\theta$ (in general, the center lead can be easily machined when the angle is small within the range of 30° to 60°) of the bent portion 4*a* of the center lead 4. Such a drawback can be completely prevented in this embodiment.

Figure 5:
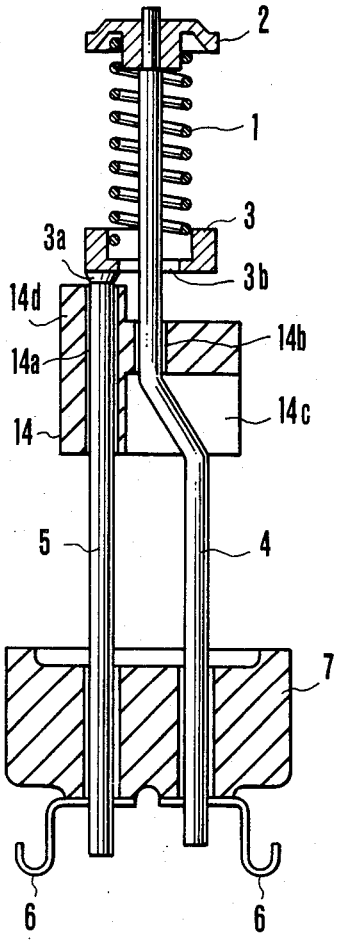

FIG. 5 is a longitudinal sectional view showing the main part of a magnetron cathode assembly according to still another embodiment. Referring to FIG. 5, a spacer 14 has a projection 14*d* above a through hole 14*a* for a side lead 5. Reference numeral 14*b* denotes a through hole; and 14*c*, a groove.

With the above structure, carbon evaporated from a filament 1 through a through hole 3*b* for a center lead 4 will not be attached to the vertical surface of the spacer 14, thereby preventing degradation of the insulating properties of the spacer 14.

Figure 6:
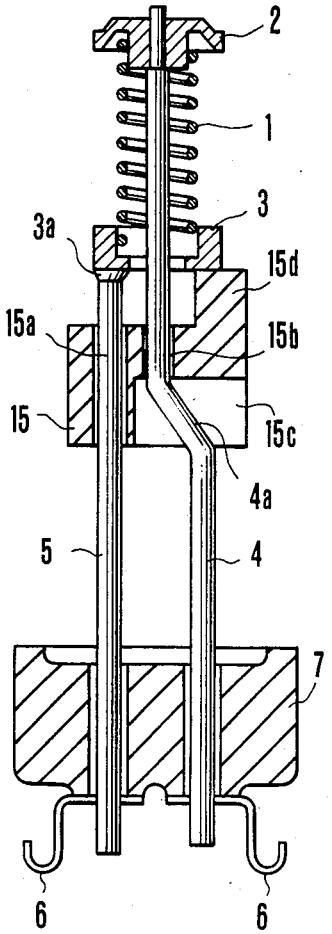

FIG. 6 is a longitudinal sectional view showing the main part of a magnetron cathode assembly according to still another embodiment of the present invention. In a similar manner to the structure of FIG. 4, an abutment portion to be in contact with a lower end shield 3 is formed in a portion of a spacer 15 which is at the side of a center lead 4. In this case, the positioning of the spacer 15 is determined by a size of a projection 15*d*, thereby accurately positioning the spacer 15 since positioning is performed without involving a welded portion 3*a* of the lower end shield. Reference numerals 15*a* and 15*b* denote through holes; and 15*c*, a groove.

Figure 7:
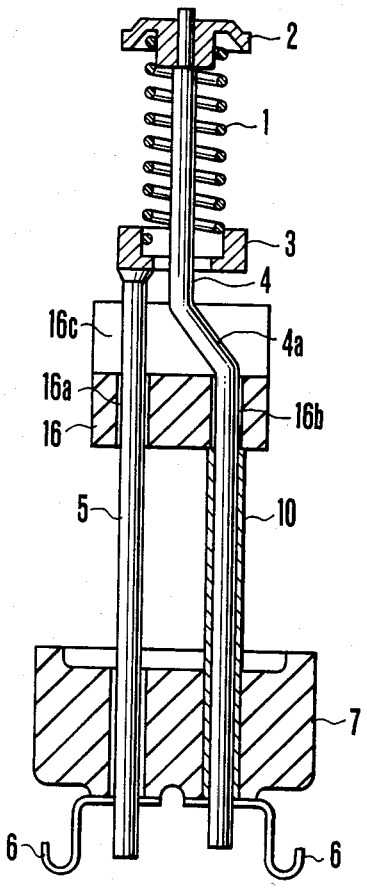

FIG. 7 is a longitudinal sectional view showing the main part of a magnetron cathode assembly according to still another embodiment of the present invention. In the spacers 11 to 15 of FIGS. 2A to 5, the groove for holding the bent portion 4*a* of the center lead 4 is formed in a spacer portion at the side of the ceramic stem 7. However, in a spacer 16 of FIG. 7, a groove 16*c* is formed at the side directed to filament 1. In addition, a center lead 4 extends through a sleeve pipe 10 the lower end portion of which is fixed in a through hole of a ceramic stem 7. Reference numerals 16*a*, 16*b*, . . . denote through holes, respectively.

With the above structure, since the center lead 4 is covered by the sleeve pipe 10, the mechanical strength of the lead 4 can be improved.

In the embodiments shown in FIGS. 2A and 2B to 7, the spacer for supporting the center and side leads clamps the bent portion of the center or side lead, thereby obtaining an antiresonance effect in all directions. Furthermore, a special fixing member need not be used for preventing the spacer from being moved. As a result, the overall structure of the assembly, and hence the manufacturing process can be simplified. If a fixing member is used, the lead diameter can be increased to improve the mechanical strength. A thin lead of an expensive material such as molybdenum can be used, and still a magnetron with high antiresonance property and high reliability can be obtained at low cost.

Figure 8A:
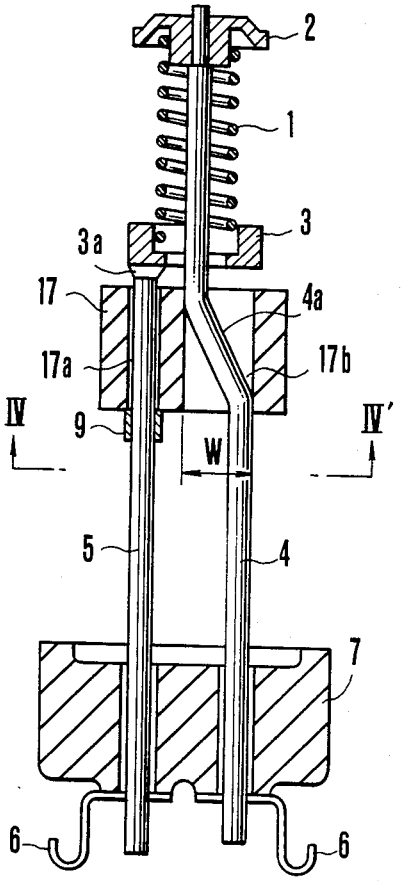
FIGS. 8A and 8B are respectively a longitudinal sectional view showing the main part of a magnetron cathode assembly according to still another embodiment of the present invention and a cross-sectional view thereof taken along the line III–III′ of FIG. 8A.
Figure 8B:
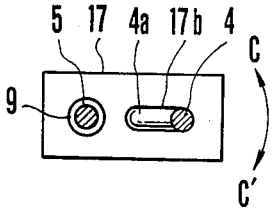

FIGS. 8A and 8B are respectively a longitudinal sectional view showing the main part of a magnetron cathode assembly according to still another embodiment of the present invention and a cross-sectional view thereof taken along the line IV–IV′ of FIG. 8A. Unlike the previous embodiments, a spacer 17 has a circular through hole 17*a* for a side lead 5 and an elliptical or rectangular (elliptical in this embodiment) through hole 17*b* for a center lead 4. The length (when viewed in FIG. 8B) of the through hole 17*b* is substantially the same as a width w of a bent portion 4*a* of the center lead 4, so that the bent portion 4*a* is fitted in the through hole 17*b*.

With the above arrangement, when the center lead 4 is apt to be moved along a direction indicated by arrow C–C′, the center lead 4 is twisted to produce a force which prevents the spacer 17 from pivotal movement along the C–C′ direction. In the assembly shown in FIGS. 2A and 2B, movement of the spacer 11 along its axial direction is stopped by the welded portion 3*a* of the side lead 5 which is obtained by welding between the side lead 5 and the lower end shield 3. The spacer 11 is also stopped by the sleeve 9. A projection (not shown) may be formed on the center lead 4 instead of the sleeve 9.

Figure 9:
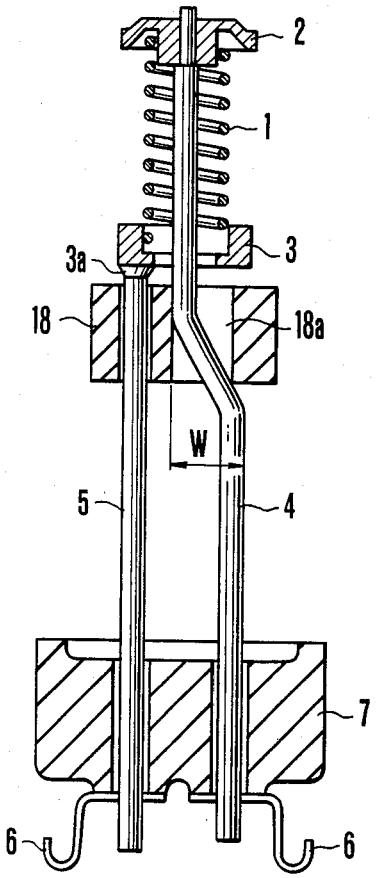
FIGS. 9 to 13 are longitudinal sectional views showing the main parts of magnetron cathode assemblies according to other embodiments of the present invention, respectively.

FIG. 9 is a longitudinal sectional view showing the main part of a magnetron cathode assembly according to still another embodiment of the present invention. Unlike the assembly of FIG. 8A, a length of a through hole 18*a* formed in a spacer 18 along a direction perpendicular to the longitudinal direction of the assembly is slightly shorter than a width w of a bent portion of a center lead 4, thereby preventing the spacer 18 from being moved toward a ceramic stem 7. With this structure, the sleeve 9 shown in FIG. 2A can be omitted.

Figure 10:
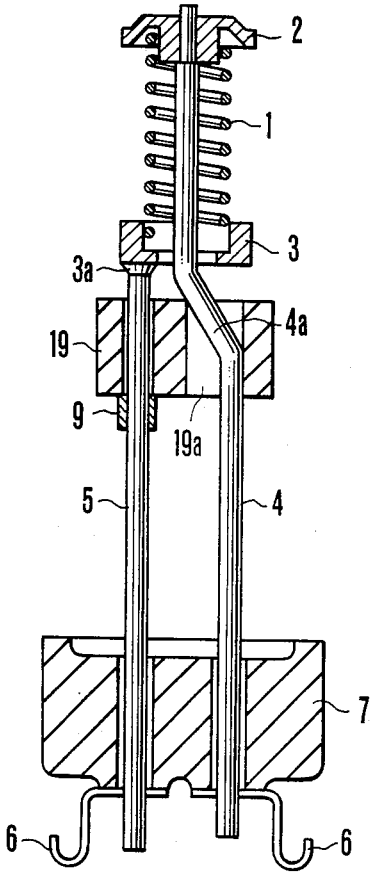

FIG. 10 is a longitudinal sectional view showing the main part of a magnetron cathode assembly according to still another embodiment. Edges of an elliptical or rectangular through hole 19*a* are brought into contact with wall surface portions of a bent portion 4*a* of a center lead 4 so as to prevent a spacer 19 from being moved toward a lower end shield 3.

With the above structure, unlike the assemblies of FIGS. 8A and 9, a welded portion 3*a* is not used to position the spacer 19. Therefore, the spacer 19 can be positioned with high precision.

Figure 11:
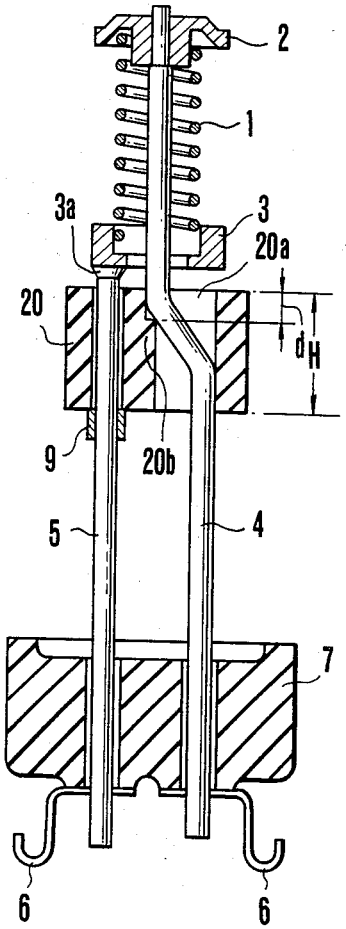

FIG. 11 is a longitudinal sectional view showing the main part of a magnetron cathode assembly according to still another embodiment of the present invention. Referring to FIG. 11, an insulating spacer 20 of a ceramic material has a step 20*b* in an elliptical or rectangular through hole 20*a* for a center lead 4. The step 20*b* has a depth d. A bent portion 4*a* of the center lead 4 is stopped by the step 20*b* so that the spacer 20 will not be moved toward a lower end shield 3. In this case, the spacer 20 is molded such that a ceramic powder is pressed by single-action press operation to set the depth d of the step 20*b* of the spacer 20 to be less than $\frac{1}{4}$ of an overall height H of the spacer 20. The spacer 20 can be manufactured at low cost. When $d \leqq H/4$ (where H is the overall height of the spacer 20 and d is the depth of the step 20*b*), although a core (not shown) of the mold forms a through hole 20*a*, a ceramic powder flow will not be interfered with, i.e., ceramic powder will flow smoothly during molding and no difference between the density at the depth d and that at a portion corresponding to a difference $(H-d)$ between the overall height H and the depth d is caused.

Figure 12:
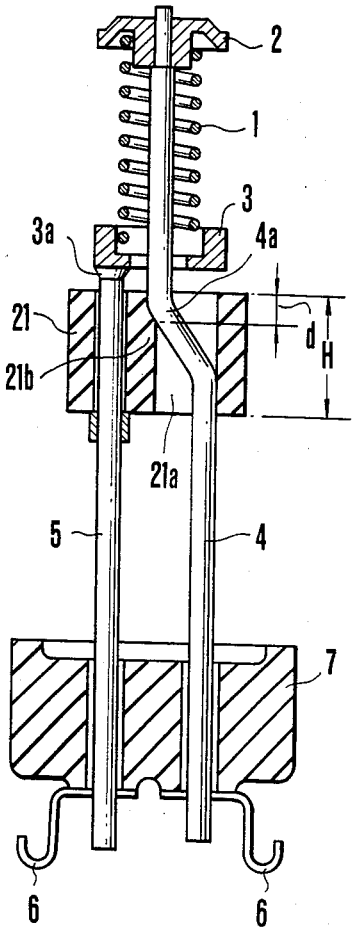

FIG. 12 is a longitudinal sectional view showing the main part of a magnetron cathode assembly according to still another embodiment of the present invention. The assembly of FIG. 12 is substantially the same as that of FIG. 11, except that a step 21*b* in an elliptical or rectangular through hole 21*a* for a center lead 4 comprises an inclined surface corresponding to the same slope as that of a bent portion 4*a*. With this structure, the same effect as in FIG. 11 can be obtained.

Figure 13:
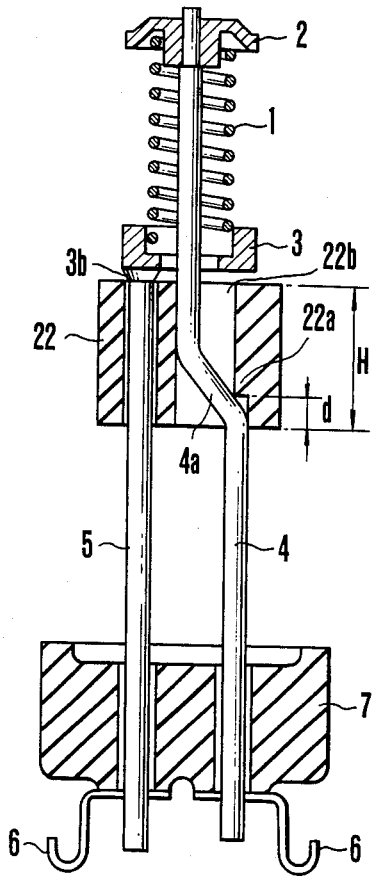

FIG. 13 is a longitudinal sectional view showing the main part of a magnetron cathode assembly according to still another embodiment of the present invention. Referring to FIG. 13, an insulating ceramic spacer 22 has a step 22*a* which is in contact with and thereby prevents a bent portion 4*a* and, hence, the remaining portion of a center lead 4 from being moved toward a ceramic stem 7. In this case, an overall height H of a spacer 22 and a depth d of the step 22*a* satisfy inequality $d \leqq H/4$. Reference numeral 22*b* denotes an elliptical or rectangular through hole for the center lead 4. With this structure, the same effect as in the above embodiments can be obtained.

Among the embodiments described above, in the embodiments shown in FIGS. 8A and 8B, 9 and 13, the welded portion 3*a* is used to prevent the spacer from being moved toward the lower end shield. For this purpose, however, a projection may be formed in the side lead 5.

According to the embodiments shown in FIGS. 8A and 8B to 13, the ceramic spacer has the bent portion of the center lead, thereby obtaining high resistance to vibration in all directions. In addition, the spacer itself can be easily manufactured, thereby providing a highly reliable magnetron having a high resistance to vibration at low cost.

What is claimed is:

1. A magnetron cathode assembly having a filament for emitting thermoelectrons, upper and lower end shields fixed at upper and lower ends of said filament, a center lead fixed at and connected to said upper end shield, a side lead fixed at and connected to said lower end shield, and an insulating spacer having through holes with which said center and side leads are respectively engaged, wherein said insulating spacer comprises a groove which has a width substantially the same as a diameter of one of said through holes and which clamps a bent portion of at least one of said center and side leads.

2. An assembly according to claim 1, wherein said center and side leads have substantially the same diameter as said through holes, respectively.

3. An assembly according to claim 2, wherein a step is formed in said groove of said spacer and is in contact with part of said bent portion of said at least one of said center and side lead, thereby preventing said spacer from being moved along an axis of a corresponding one of said center and side lead.

4. An assembly according to claim 2, further comprising a cylindrical sleeve mounted on at least one of said center and side leads so as to position said spacer.

5. An assembly according to claim 1, wherein said through hole of said side lead has a circular shape, and said through hole of said center lead has an elliptical shape.

6. An assembly according to claim 1, wherein said through hole of said side lead has a circular shape and said through hole of said center lead has a rectangular shape.

7. An assembly according to claim 6, wherein a step is formed in said through hole of said center lead and in contact with an inclined portion of said center lead so as to support said bent portion thereof.

8. An assembly according to claim 7, wherein a depth of said step is not more than $\frac{1}{4}$ of a height of said spacer.

9. An assembly according to claim 8, wherein said step has a right-angled shape.

10. An assembly according to claim 8, wherein said step has an inclined surface corresponding to a slope of said bent portion of said center lead.

* * * * *